United States Patent [19]

McClure

[11] 4,366,620

[45] Jan. 4, 1983

[54] ROOF SEAM CUTTING MACHINE

[75] Inventor: Richard R. McClure, Basehor, Kans.

[73] Assignee: Butler Manufacturing Company, Kansas City, Mo.

[21] Appl. No.: 237,522

[22] Filed: Feb. 23, 1981

[51] Int. Cl.³ ..... B26B 15/00

[52] U.S. Cl. ..... 30/264; 30/265; 30/273

[58] Field of Search ..... 30/263, 264, 265, 228, 30/, 231, 240, 379.5, 306, 307, 292, 273; 29/243.57, 426.1, 426.4

[56] References Cited

U.S. PATENT DOCUMENTS

| | | | |
|---|---|---|---|
| 326,163 | 9/1885 | Shepard | 30/265 |
| 2,642,658 | 6/1953 | Johnson | 30/265 X |
| 2,728,985 | 1/1956 | Quackenbush | 30/265 |
| 3,120,828 | 2/1964 | Gronlund | 29/243.57 |

*Primary Examiner*—Jimmy C. Peters

*Attorney, Agent, or Firm*—Shoemaker and Mattare, Ltd.

[57] ABSTRACT

A machine for cutting standing seams which connect roof panels together includes a cutter wheel located adjacent a platen wheel. The cutter wheel is movable and is moved toward the platen wheel by a jack-screw mechanism mounted on the frame of the machine.

8 Claims, 6 Drawing Figures

ROOF SEAM CUTTING MACHINE

BACKGROUND OF THE INVENTION

The present invention relates in general to building roofs, and, more particularly, to equipment associated with building roof panels.

The assignee of the present invention manufactures a roof panel under the trademark MR-24, and these panels are edge seamed together when a roof of a building is being constructed. It is noted that MR-24 is a trademark, but for the sake of brevity, will not have a trademark designation associated therewith hereinafter. However, it is understood that no rights are being given up by this lack of designation.

Due to unforeseen reasons, there are times when an MR-24 roof panel must be replaced. Because of the above-mentioned seamed attachment, it may be difficult and time consuming to replace such panels with presently known methods of removal. The known methods of removal include the following.

A hot saw is a fairly fast way of removal; however, a hot saw is very hazardous. Another important problem with a hot saw is due to abrasive particles of the blade and metal shavings from the cut being thrown onto adjacent roof panels. Such particles and shavings can cause corrosion if not very carefully cleaned off of the panels.

Another known method of panel removal includes use of a hammer and chisel. This method includes use of a chisel to cut through a panel and the attaching tabs. However, this method is very time consuming, and, after cutting the tabs of the panels loose, the roof is still in one piece so that removal of the damaged panel is difficult. Cutting of the panel with a shear or hot saw is often still required with this method of damaged panel removal.

All other prior art means of panel removal have problems which make it difficult to effect easy panel removal, and these methods also leave an undesirable condition.

SUMMARY OF THE INVENTION

The device embodying the teachings of the present invention includes a modification of the roof seaming machine disclosed in U.S. Pat. No. 3,120,828.

The modification includes replacing the front wheel assembly of the afore-mentioned roof seaming machine with a new front wheel assembly, and replacing one of the drive assemblies with a seam cutting assembly. A jack screw assembly permits in situ adjustments of the cutting assembly.

The cutting assembly is preferably located on the roof seaming machine where the third drive assembly thereof is located. The cutting assembly cuts the standing seam of the installed MR-24 roof panel in a manner analogous to the way a can opener cuts the lid of a can.

The device embodying the teachings of the present invention enables panels of the roof to be completely cut loose of attachment to a building structural element, and individually removed.

The device of the present disclosure leaves few or no metal shavings, and permits an old panel, after cutting, to be weight bearing.

The cutting loose of a panel using the device embodying the teachings of the present invention is rapid, safe, simple, convenient and economical as compared to known devices.

OBJECTS OF THE INVENTION

It is a main object of the present invention to remove a panel from a roof composed of MR-24 panels.

It is another object of the present invention to remove a panel from a roof composed of MR-24 panels in a simple, economical and safe manner.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
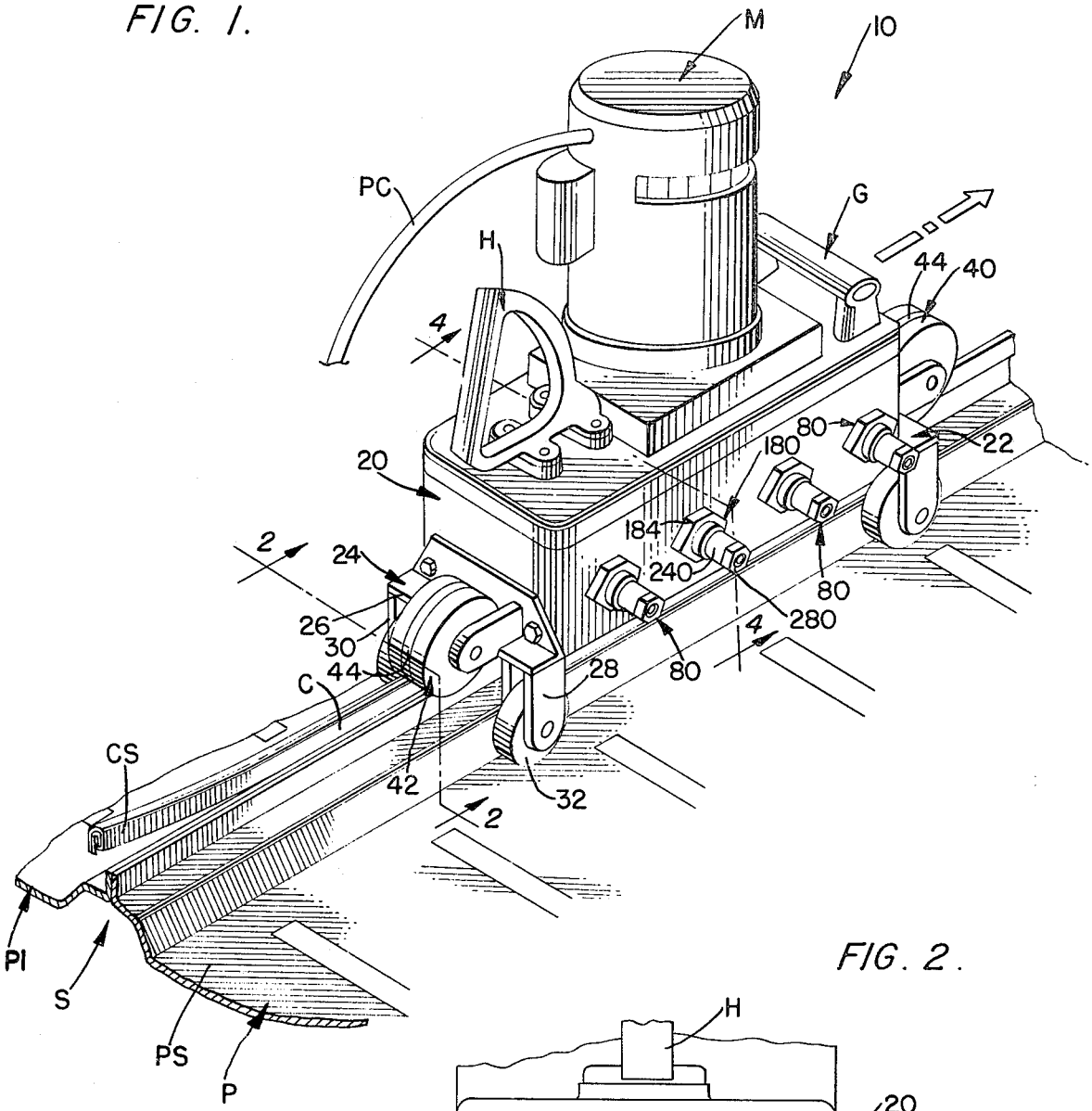
FIG. 1 is a perspective view of the seam cutting device embodying the teachings of the present invention.

Shown in FIG. 1 is a seam cutter 10 embodying the teachings of the present invention. The seam cutter is used in conjunction with adjoined panels P and P1 which are edge-adjoined by seam S. The panels have planar surfaces PS, and the seam S is best described in U.S. Pat. No. 4,060,944, which is fully incorporated herein by reference thereto, and includes an upstanding cuff portion C which is doubly folded to join the panels together.

As above-discussed, should one or more panels become damaged sufficiently to require removal or replacement, the seam S must be cut to free the joined panels from the damaged panel.

The seam cutter 10 effects such seam cutting, and is the subject of the present invention. The seam cutter 10 is an improvement of the seaming machine disclosed in U.S. Pat. No. 3,120,828, and attention is directed to this patent for a detailed description thereof. The disclosure of U.S. Pat. No. 3,120,828 is fully incorporated herein by reference thereto, and thus, the seam cutter 10 will be described in only a broad manner. Details can be obtained by referring to the just-referenced patent.

Figure 2:
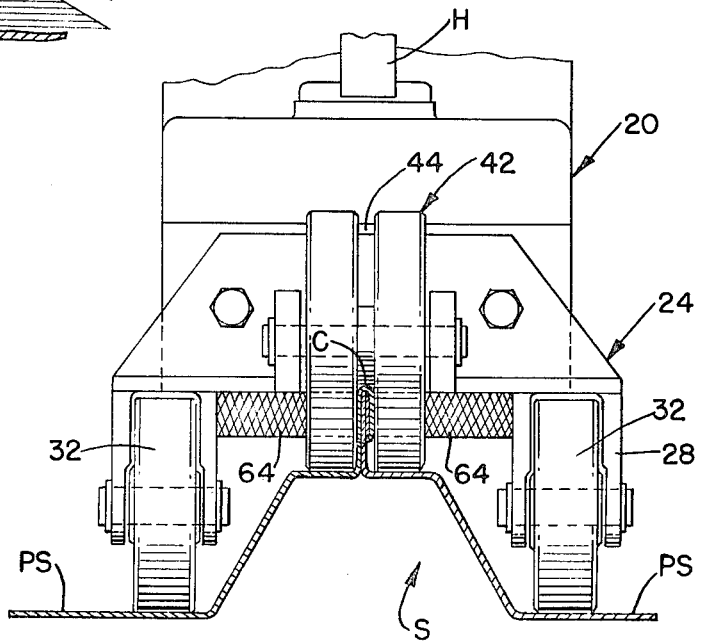
FIG. 2 is a rear elevation view taken along line 2—2 of FIG. 1.
Figure 3:
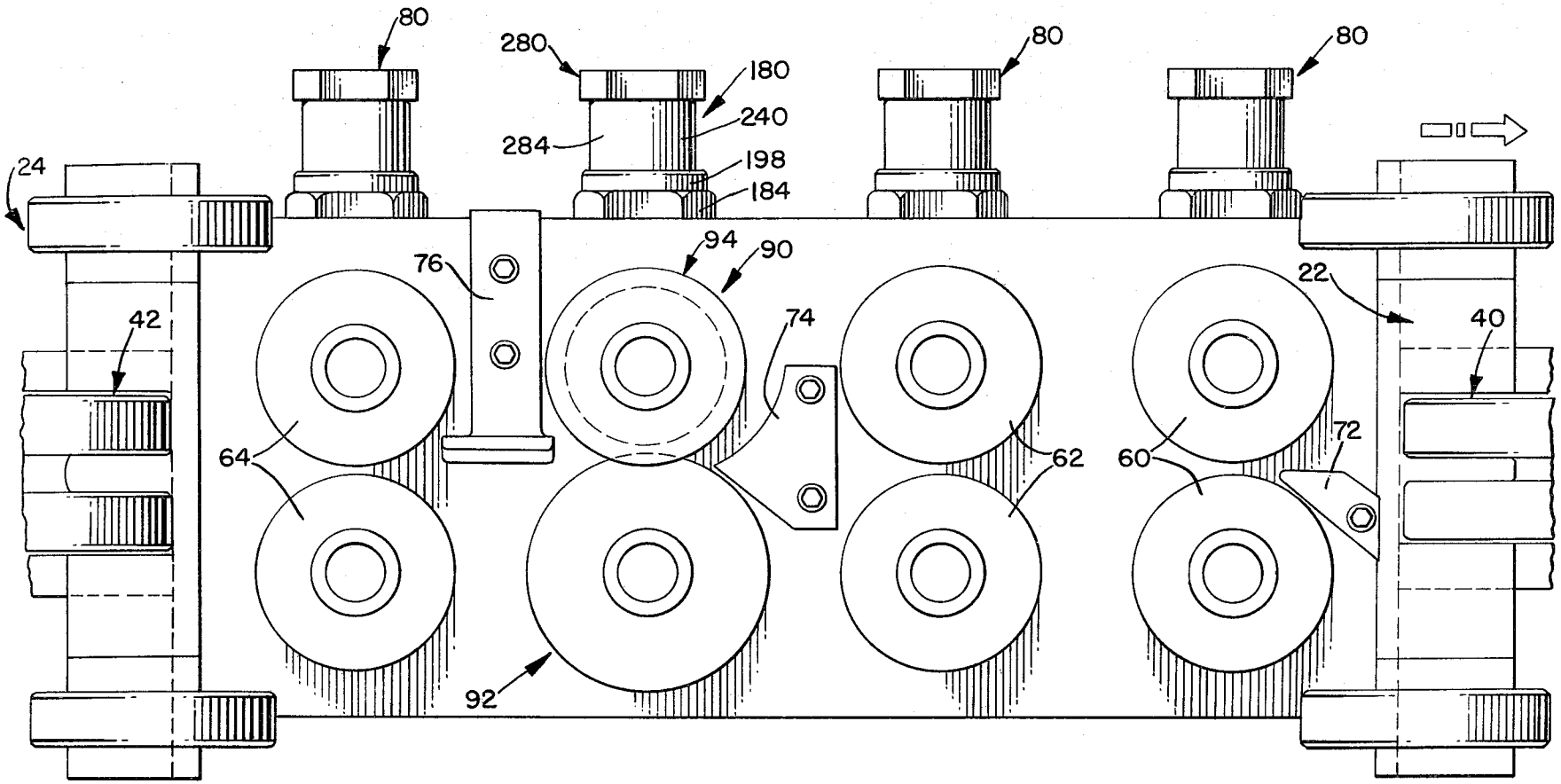
FIG. 3 is a bottom view of the seam cutting device embodying the teachings of the present invention.

The seam cutter 10 is shown in FIGS. 1–3 to include a body 20 mounted on stem and stern bogies 22 and 24, respectively. Each bogie includes a mounting bracket 26 and a pair of wheel mounts 28 and 30 to which support wheels 32 are rotatably attached. The support wheels ride on the panel planar surfaces on either side of the seam being cut, as best shown in FIG. 1. The support wheels are preferably rubber, or the like.

A leading guide wheel 40 is mounted on the stem bogie, and a rear guide wheel 42 is mounted on the stern bogie. The guide wheels are circumferentially bifurcated to define circumferential notches 44 therein. These notches ride on the seam S, as best shown in FIG. 1. The seam S thus forms a trackway for the seam cutter. The cut portion CS of the seam is shown in FIG. 1 to be separated from the rest of the seam. This cut portion includes the double fold, so the panels are separated from each other by the cutting operation.

A motor M is mounted on top of the body of the seam cutter, as is a handle H and a grab bar G. The motor M is shown as an electric motor with power and/or control cord PC connected thereto. However, other types of motors can be used without departing from the scope of this disclosure.

The motor M drives, through an appropriate drive train (not shown) paired drive wheels 60, 62 and 64 which are mounted on the bottom of the seam cutter body. As shown in FIG. 2, the drive wheels have the circumferential edges thereof knurled and are located on opposite sides of the seam. The wheels are positioned to sandwich the seam therebetween and grasp that seam. Driving the drive wheels thus moves the seam cutter. Wear plates 72, 74 and 76 are also mounted on the bottom of the seam cutter body. The positions of the drive wheels are controlled by assemblies 80 which are fully discussed in the referenced U.S. Pat. No. 3,120,828.

Figure 4:
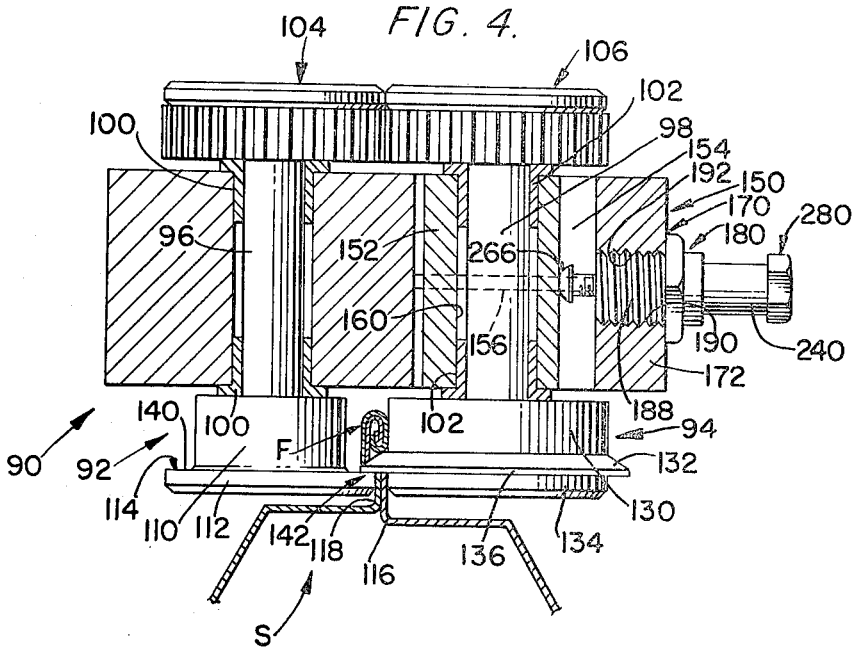
FIG. 4 is an elevation view taken along line 4—4 of FIG. 1.
Figure 5:
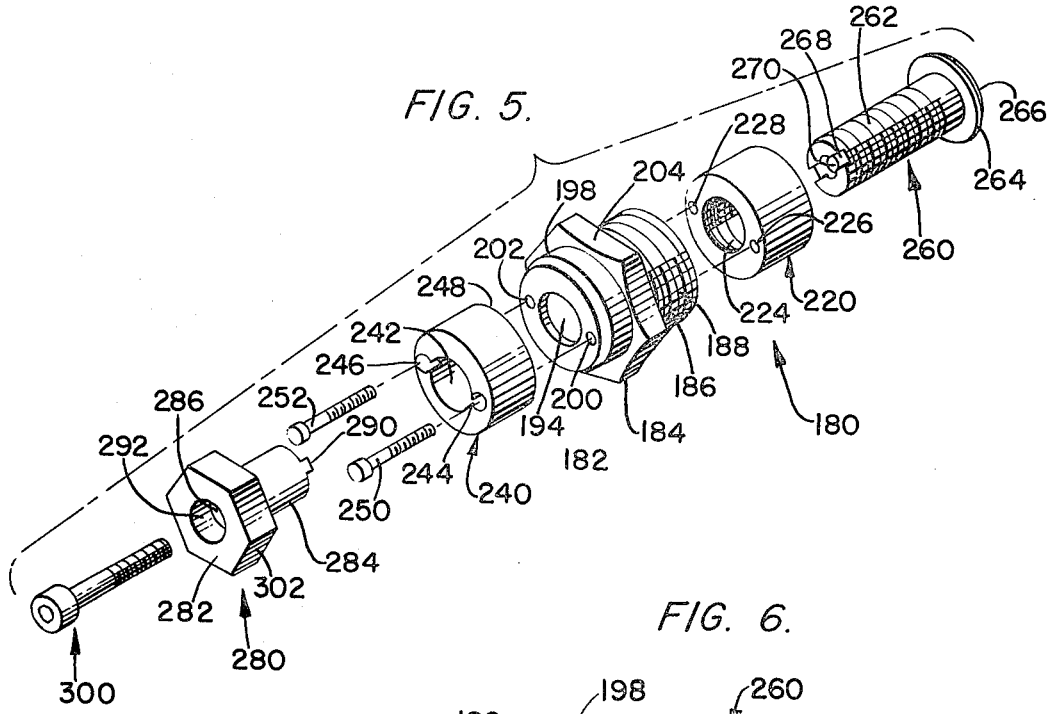
FIG. 5 is an exploded perspective view of a cutting wheel adjustment means used in the seam cutting device embodying the teachings of the present invention.

A cutter assembly 90 is best shown in FIGS. 4 and 5, and attention is directed thereto. The cutter assembly includes a platen wheel 92 and a cutter wheel 94. The wheels are mounted on parallel shafts 96 and 98, which are rotatably mounted by bearings 100 and 102 on the seam cutter body 20. Meshed gears 104 and 106 drive the platen and cutter wheels, and are driven by the motor M via an appropriate drive chain.

As shown in FIG. 4, the platen wheel 92 includes a cylindrical portion 110 and a flange portion 112 which extends radially outwardly of the cylindrical portion to form a shoulder 114, and which has a circumferential edge 116 positioned to engage planar portion 118 of the upstanding seam portion. The wheels 92 and 94 are fixed against movement longitudinally of the shafts 96 and 98 by appropriate means which can include keys, keyways, locks, lock washers, caps, adapters, or the like. Additionally, the platen wheel is fixed against movement which is directed transversely of the shaft 96.

The cutter wheel includes a cylindrical portion 130, a skirt portion 132, and a cylindrical portion 134. The skirt portion is flared outwardly and downwardly from the first cylindrical portion 130, and includes a cutting edge 136 located on the outer peripheral edge of the skirt portion.

As shown in FIG. 4, in a cutting position, the skirt is located superjacent top surface 140 of the platen flange 112, and extends thereover to be in overedge orientation therewith and to form an overlap 142 with the cylindrical portion 134 located approximately coplanar with the flange 112 of the platen wheel so that the planar portion of the upstanding seam portion is captured therebetween. Both of the wheels are positioned so that the overlap 142 is located beneath the folded portion F of the seam, as is shown in FIG. 4. The cutter skirt 132 will thus extend through the planar portions of the seam to cut the folded portion off the rest of the panel seam.

The cutter wheel is moved transversely of the shaft 98 to move into the FIG. 4 cutting position. This wheel is thus mounted on the seam cutter body 20 by a wheel positioning assembly 150. The assembly 150 includes a mounting block 152 located within a chamber 154 defined in the body 20. The block 152 is movable transversely of the shaft 98 and is held in the chamber by key means 156, or the like. The key means also prevents movement of the block 152 in the longitudinal direction of the shaft 98. The block 152 has a bore 160 defined therethrough which accommodates the shaft 98 and the bearings associated therewith.

Figure 6:
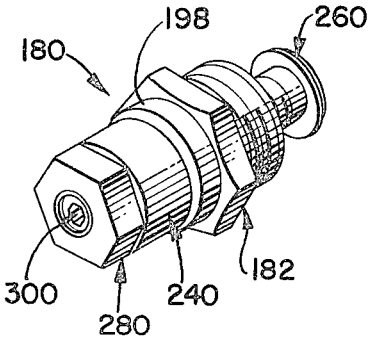
FIG. 6 is a perspective view of an assembled cutter wheel adjustment means used in the seam cutting device embodying the teachings of the present invention.

A block moving means 170 is positioned adjacent the block 152 and includes a mounting flange 172 on the body 20. A jackscrew assembly 180 is mounted in the flange and is best shown in FIGS. 5 and 6. The assembly 180 includes a bonnet nut 182 having a polygonal portion 184 attached to one end of a tubular skirt 186. The skirt includes external threads 188 which cooperate with threads 190 defined on the inner surface of bore 192 defined through the flange 172 to securely hold the bonnet nut in the flange 172. The skirt 186 has a bore 194 defined longitudinally thereof and has a crown portion 198 on top of the polygonal portion. Parallel bores 200 and 202 are defined through the crown and polygonal portions adjacent the bore 194. The polygonal portion has planar faces 204 which are engaged by a wrench or the like to set the bonnet nut in the flange 172.

The jackscrew assembly further includes a tubular sheath 220 which includes an internally threaded bore 224 and a pair of parallel bores 226 and 228 located adjacent the bore 224. The sheath is telescopingly received in the bore 194 with the parallel bores of the sheath aligned with the parallel bores of the bonnet. The bores of the sheath are internally threaded.

A tubular collar 240 includes a bore 242 defined longitudinally thereof and a pair of parallel bores 244 and 246 defined adjacent the bore 242. The crown portion 198 abuts surface 248 of the collar and the bonnet parallel bores are aligned with the collar bores so that set screws 250 and 252 are received in the aligned parallel bores as indicated in FIG. 5. The set screws are threaded into the sheath bores 226 and 228 to couple the sheath and the collar to the bonnet nut.

A shuttle bolt 260 is in the form of a round head bolt and includes a threaded body 262 and a head 264. The shuttle bolt is threadably mounted in the sheath bore 224 and includes a top surface 266 and a key slot 268 on opposite ends thereof. As shown in FIG. 4, the bolt top surface 266 abuts the mounting block 152 so that movement of the shuttle bolt out of the bore 224 causes corresponding sideways movement of the mounting block 152 toward the platen wheel. Movement of the block 152 in the opposite direction can be effected by hand, or other suitable means. A bore 270 is defined in the end of the shuttle bolt having the keyway defined therein and extends longitudinally of the bolt. The bore 270 is internally threaded.

A lug nut 280 includes a polygonal head 282 and a cylindrical body 284 with a bore 286 defined longitudinally therethrough. A key 290 is mounted on one end of the body 284 and a counterbore 292 is defined around the bore 286.

A set screw 300 is received through the bore 286 and is threadably attached to the shuttle bolt bore 270 to attach the lug nut to the shuttle bolt with the key 290 received in the slot 268. The lug nut cylindrical portion is received through the collar bore 242 and the sheath bore 224. The lug nut polygonal head includes planar portions 302 which receive a wrench or other suitable tool to turn the lug nut about the longitudinal axis thereof.

Turning the lug nut about the longitudinal axis thereof causes corresponding rotation of the shuttle bolt about the longitudinal axis thereof. Thus, forward rotation of the shuttle bolt results in that bolt being screwed into the sheath bore, and retrograde rotation of the shuttle bolt results in movement of the shuttle bolt out of the sheath bore. Such movement of the shuttle bolt results in movement toward, or away from, the mounting block 152. Movement of the shuttle bolt toward the block 152 far enough will result in contact between the bolt head and the block 152, and further movement of the shuttle bolt by the lug nut causes sideways movement of the mounting block 152 so that in situ adjustments of the cutter wheel position can be made. The lug nut is located outboard of the body 20 for easy access thereto. The gears 104 and 106 are properly meshed when the cutter and platen wheels are in the proper cutting orientations. The cutter wheel can thus be moved into the cutting position shown in FIG. 4 from an open position.

The assembled jackscrew assembly is best shown in FIG. 5.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A machine for cutting a standing seam connecting roof panels together comprising:

a body;

means on said body for moving the machine along a standing seam to be cut;

a platen wheel mounted on said body to be located on one side of the standing seam;

a cutter wheel mounted on said body to be located on a side of the seam opposite said platen wheel;

mounting means movably mounting said cutter wheel on said body;

a jackscrew mechanism mounted on said body adjacent said mounting means for moving said mounting means toward said cutter wheel, said jackscrew mechanism including a bonnet nut having a bore defined therethrough, a shuttle bolt threadably received in said bonnet nut and having a head on one end and a slot on an opposite end, a lug nut having a key on one end thereof, said key being engaged with said shuttle bolt slot so that rotation of said lug nut about the longitudinal axis thereof causes corresponding rotation of said shuttle bolt about the longitudinal axis thereof so that said shuttle bolt moves longitudinally with respect to said bonnet nut; and cutting means fixed on said cutter wheel to cooperate with said platen wheel to cut the seam.

2. The machine defined in claim 1 wherein said jackscrew mechanism further includes a tubular sleeve located within said bonnet nut bore and having an internally threaded bore defined therethrough, with said shuttle bolt being threadably received in said sleeve threaded bore, and further wherein said lug nut includes a cylindrical body with a head on another end thereof and wherein said lug nut body is received in said bonnet nut bore and said sleeve bore.

3. The machine defined in claim 2 wherein said jackscrew mechanism further includes a tubular collar mounted on said bonnet nut, connecting means connecting said collar and said sleeve to said bonnet nut and attaching means attaching said lug nut to said shuttle bolt.

4. The machine defined in claim 3 wherein said bonnet nut further includes jackscrew mounting means for mounting said jackscrew mechanism on said body.

5. The machine defined in claim 4 further including a leading guide wheel mounted on said frame to roll on the seam ahead of the machine and a following guide wheel mounted on said body to roll on the seam behind the machine.

6. The machine defined in claim 4 wherein said cutting means includes a cutting means body and a skirt on said body, said skirt being located on said cutting means body to cooperate with said platen wheel and to engage the seam like a can opener to cut that seam when in a cutting position.

7. The machine defined in claim 1 wherein the standing seam includes a planar portion located between said cutter and platen wheels and a folded portion located between said body and said cutter and platen wheels so that said folded portion is separated from said planar portion by said cutting means.

8. The machine defined in claim 7 wherein said folded portion includes a double fold.

* * * * *